US005295568A

United States Patent [19]

Saito et al.

[11] Patent Number: 5,295,568

[45] Date of Patent: Mar. 22, 1994

[54] PASSENGER CONVEYOR AND TREADBOARD CONSTRUCTION FOR PASSENGER CONVEYOR

[75] Inventors: Chuichi Saito, Katsuta; Kazuhira Ojima, Kasama; Masao Nakazato, Katsuta, all of Japan

[73] Assignee: Hitachi, Ltd., Tokyo, Japan

[21] Appl. No.: 29,350

[22] Filed: Mar. 10, 1993

Related U.S. Application Data

[63] Continuation of Ser. No. 670,198, Mar. 15, 1991, abandoned.

[30] Foreign Application Priority Data

Mar. 19, 1990 [JP] Japan ..... 2-67401

[51] Int. Cl.[5] ..... B66B 21/00

[52] U.S. Cl. ..... 198/330; 198/333; 198/619; 198/805

[58] Field of Search ..... 198/321, 330, 331, 333, 198/619, 805

[56] References Cited

U.S. PATENT DOCUMENTS

| | | | |
|---|---|---|---|
| 3,321,060 | 5/1967 | Mullis et al. | 198/321 |
| 3,731,166 | 5/1973 | Inuzuka et al. | 198/619 X |
| 4,565,276 | 1/1986 | Dengs et al. | 198/321 |
| 4,738,346 | 4/1988 | Matsueda et al. | 198/330 |
| 4,792,036 | 12/1988 | Heidelberg | 198/805 X |
| 5,172,803 | 12/1992 | Lewin | 198/805 X |

FOREIGN PATENT DOCUMENTS

| | | | |
|---|---|---|---|
| 62-136489 | 12/1985 | Japan . | |
| 62-100395 | 5/1987 | Japan . | |
| 1305147 | 1/1973 | United Kingdom . | |
| 2096966 | 10/1982 | United Kingdom | 198/619 |

*Primary Examiner*—Cheryl L. Gastineau
*Attorney, Agent, or Firm*—Antonelli, Terry, Stout & Kraus

[57] ABSTRACT

In a passenger conveyor, in order to reduce installation dimensions and, more particularly, a height of the passenger conveyor, the passenger conveyor is constructed to be driven by a linear motor, with stators and moving members of the linear motor being formed such that surfaces thereof facing each other are located in horizontal planes and generated magnetic flux of the stators is perpendicular to the facing surfaces. The moving members are mounted on the respective treadboards.

19 Claims, 8 Drawing Sheets

PASSENGER CONVEYOR AND TREADBOARD CONSTRUCTION FOR PASSENGER CONVEYOR

This application is a continuation application of Ser. No. 07/670,198, filed Mar. 15, 1991, abandoned.

BACKGROUND OF THE INVENTION

This invention relates to a passenger conveyor, such as an escalator and an electrically-operated road (moving side-walk), moving in a horizontal or an inclined direction for carrying passengers, and also to a treadboard construction for use in such a passenger conveyor and, more particularly, to a passenger conveyor driven by a linear motor and treadboard construction for such a passenger conveyor.

Passenger conveyors of the aforementioned type in which treadboards are driven by a linear motor are known, for example, from U.S. Pat. Nos. 3,731,166 and 4,738,346 and Japanese Patent Unexamined Publications 62-100395 and 62-136489.

There is also known a technique, for example, from GB 2096966A, in which an endless flexible belt such as a moving handrail is driven by a linear motor.

In the above conventional technique for driving the treadboards by the linear motor, the dimensions of installation of the passenger conveyor have not been taken into consideration, and, therefore, a problem arises in that the passenger conveyor has an increased size. The purpose of the above conventional technique for driving an endless flexible belt, such as a moving handrail, by the linear motor is different from the purpose of the passenger conveyor of the type in which a number of treadboards are connected together in an endless manner, and the dimensions (particularly, the height) of installation of the passenger conveyor utilizing this technique have not been taken into consideration, as is the case with the first-mentioned prior art.

SUMMARY OF THE INVENTION

It is an object of this invention to provide a passenger conveyor in which a linear motor can be mounted without increasing the size of the passenger conveyor.

Another object of the invention is to provide a linear motor-driven passenger conveyor which can smoothly move treadboards.

According to one aspect of the present invention, there is provided a passenger conveyor in which a linear motor (drive means) is provided between an advance-travel path of treadboards and a return-travel path thereof disposed below the advance-travel path, and stators and moving members which jointly constitute the linear motor are formed into a flattened configuration.

According to another aspect of the invention, there is provided a passenger conveyor in which gap-keeping means is provided between each stator of the linear motor and each treadboard to maintain a gap between the stator and each moving member of the linear motor.

Since the stators and the moving members of the linear motor are formed into a flattened configuration, the linear motor can be mounted in a small space between the advance-travel path and the return-travel path of the treadboards. By providing the gap-maintaining means, the running resistance concentrating on the treadboards and guide members for them can be dispersed, thereby achieving a smooth movement of the treadboards.

DESCRIPTION OF THE PREFERRED EMBODIMENTS

Figure 3:
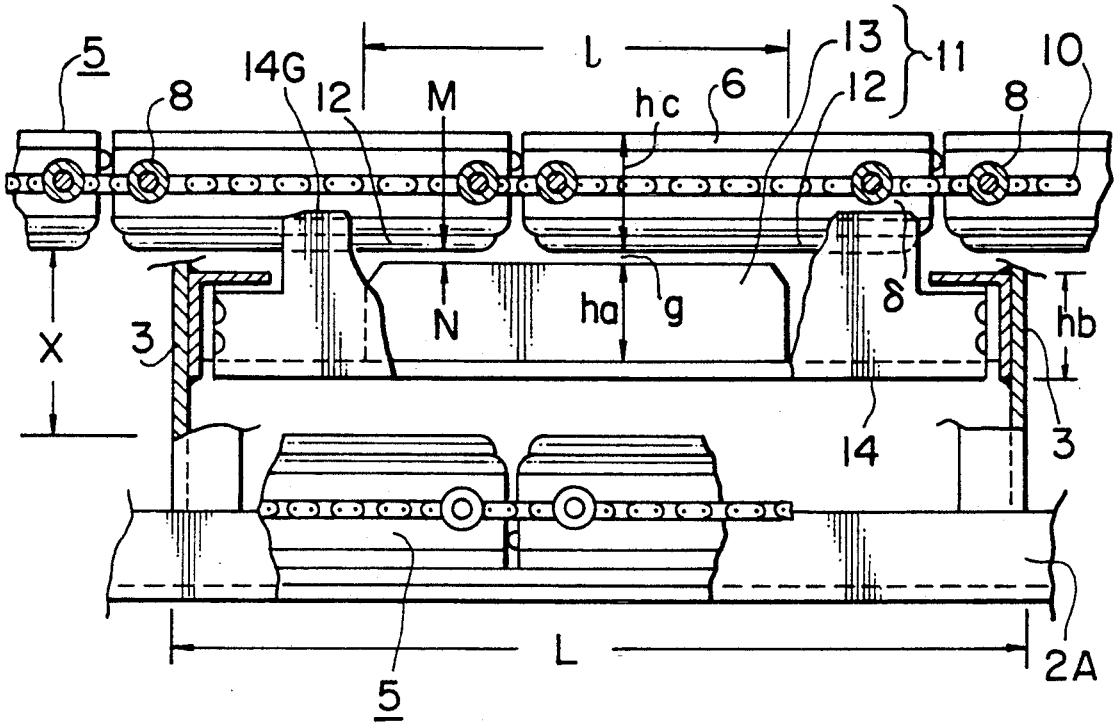
FIG. 3 is a partially broken away enlarged view of a portion of FIG. 1.

One embodiment of the invention will now be described with reference to the accompanying drawings, with the embodiment being directed to an electrically-operated road (moving sidewalk) for carrying passengers in a horizontal direction, wherein a main frame 1 is formed, for example, by a combination of angle steel members of an L-shape cross-section. More specifically, the main frame 1 comprises a pair of right and left main frame members 2A and 2B, and horizontal members 3 interconnecting the right and left main frame members 2A and 2B at a plurality of regions spaced along the length of the main frame members 2A and 2B. Although not shown in the drawings, a pair of advance-travel guide rails 4U and a pair of return-travel guide rails 4D, which guide treadboards 5 (later described), are supported on the main frame 1. Each of the treadboards 5 comprises a horizontal tread portion 6 for supporting the passenger, and reinforcement members 7A and 7B mounted on the reverse surface of the tread portion 6. The treadboard 5 has a height dimension or thickness hc. The treadboard 5 has two shafts 8 extending through the pair of reinforcement members 7A provided respectively at the lateral side portions of the treadboard 5. A pair of rollers 9 are respectively rotatably supported on the opposite ends of each shaft 8. Since the two shafts 8 are respectively provided at the front and rear portions of the treadboard 5 spaced from each other in the direction of travel of the treadboard 5, four rollers 9 per treadboard 5 move on and along the advance-travel guide rails 4U or the return-travel guide rails 4D. The shafts 8 are connected at their opposite end portions to a pair of endless chains or endless elongated members 10, so that the treadboards 5 are interconnected in an endless manner. The treadboards 5 thus interconnected are driven by a linear motor 11. The linear motor 11 is, for example, a linear induction motor which comprises stators 13 and moving members 12 disposed so as to be opposed to the stators 13. Although not shown in the drawings, the stator 13 comprises a stator core and a stator coil wound on the stator core. The linear motor 11 is driven by a commercial electric power source or through an inverter. The moving member 12 is composed solely of a non-magnetic conductor such as aluminum and copper, or is composed of a composite material having a non-magnetic conductor laminated on a surface of a magnetic material. A pair of moving members 12 are fixedly secured directly to the reinforcement member 7B, mounted on the reverse side of each treadboard 5, by conventional means such as bolts and welding. The pair of moving members 12 (12A and 12B) are respectively provided at the opposite lateral side portions of each treadboard 5 in a symmetrical relationship to each other. On the other hand, the stators 13 are supported by the horizontal members 3 of the main frame 1 so as to be opposed to the moving members 12*a* and 12B. More specifically, the stators 13 (13A and 13B) are respectively supported on support frames 14, and each pair of support frames 14 extend between and are fixed to the adjacent horizontal members 3 (FIG. 3). The height dimension ha of the stators 13A and 13B, disposed in a space L between the adjacent horizontal members 3 and disposed in a space X between an advance-travel path and a return-travel path of the treadboards 5, overlaps the height dimension hb of the horizontal members 5 in the direction of the height. The stators 13A and 13B are spaced a slight distance g from the moving members 12A and 12B.

Figure 4:
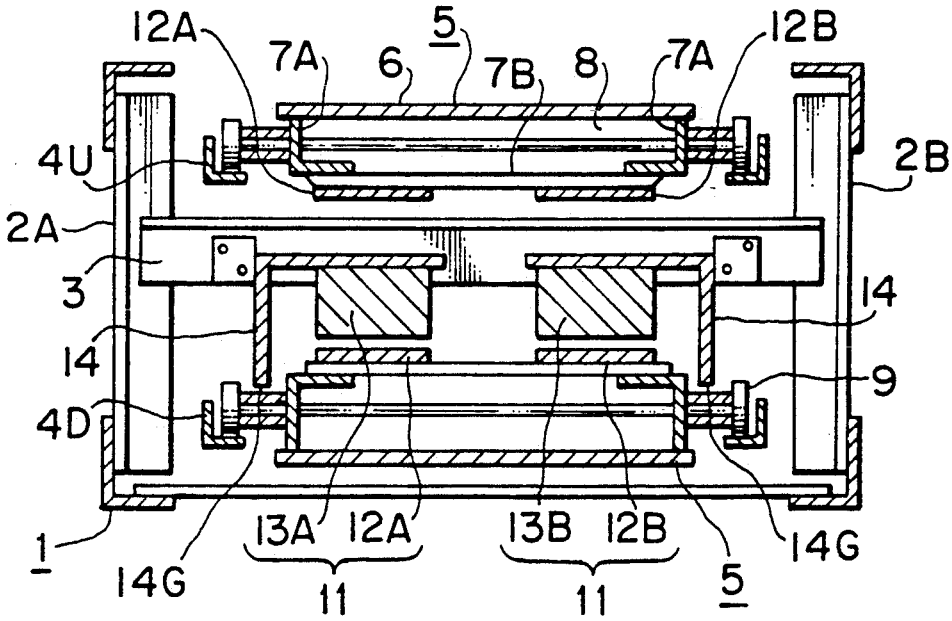
FIG. 4 is an enlarged, vertical cross-sectional view taken along the line IV—IV of FIG. 1.

The above construction is for the advance travel side of the treadboards 5. As shown in FIG. 4, with respect to the return travel side, the stators 13A and 13B are mounted between the adjacent horizontal members 3 through the support frames 14, and are directed downward so as to face the moving members 12A and 12B fixedly mounted on the reverse side of the treadboards 5.

The support frame 14 has a guide edge 14G opposed to the shafts 8, extending through the treadboard 5, with a slight gap δ (FIG. 3), and the guide edges 14G of the support frames 14 limit the attraction of the treadboard 5 toward the stators 13 which would occur as a result of the flexing of the shafts 8 due to magnetic attractive forces M and N developing between the stators 13 and the moving members 12 during the operation of the electrically-operated road. Thus, the guide edges 14G prevent the above magnetic attractive forces from becoming a burden on the rollers 9. The stators 13 (13A and 13B), as well as the moving members 12 (12A and 12B), are so formed and disposed to be flattened in the direction of travel of the treadboards 5 and in the direction of the width of the treadboard 5. The moving members 12, fixedly mounted on the reverse side of the treadboard 5, also serve as reinforcement members for reducing the flexing of the treadboard 5.

Mounting members 15 are fixedly mounted on the upper ends of the pair of right and left main frame members 2A and 2B, and balustrade panels 16 are fixedly secured at lower ends thereof to the mounting members 15. A moving handrail 17 moves along the peripheral edge of each balustrade panel 16 at the same speed as that of the treadboards 15. The lower fixed end portion of each balustrade panel 16 is covered with an inner cover 18 and an outer cover 19.

In the electrically-operated road of the above construction, by energizing the stators 13, driving forces are applied to the moving members 12, so that the treadboards 5 integrally connected to the moving members 12 move along the advance-travel guide rails 4U and the return-travel guide rails 4D, thereby conveying the passengers.

The stators 13 and the moving members 12 are formed into a flattened configuration, and are arranged so as to overlap each other vertically; therefore, the stators 13 can be disposed between the advance travel path and the return travel path of the treadboards 5, and also each pair of mating stators 13 can be disposed between the adjacent horizontal members 3. As a result, the distance S (FIG. 2) between the tread portions 6 of the treadboards 5 respectively disposed at the advance travel path and the return travel path can be made generally equal to that of a conventional electrically-operated road. Therefore, in the linear motor-driven road of this embodiment, the height dimension below the tread portion 6 of the treadboard 5 at the advance travel path (in other words, the height of the main frame 1) will not be increased; therefore, the size of this electrically-operated road is not increased.

Each pair of mating moving members 12A and 12B are respectively fixedly mounted at the lateral side portions of the treadboard 5; therefore, the moments tending to displace or deform the treadboard 5 about the rollers 9 toward the stators 13A and 13B due to the magnetic attractive forces by the stators 13A and 13B can be limited to the minimum. The treadboard 5 can accordingly be reduced in rigidity and hence can be light-weight.

Figure 5:
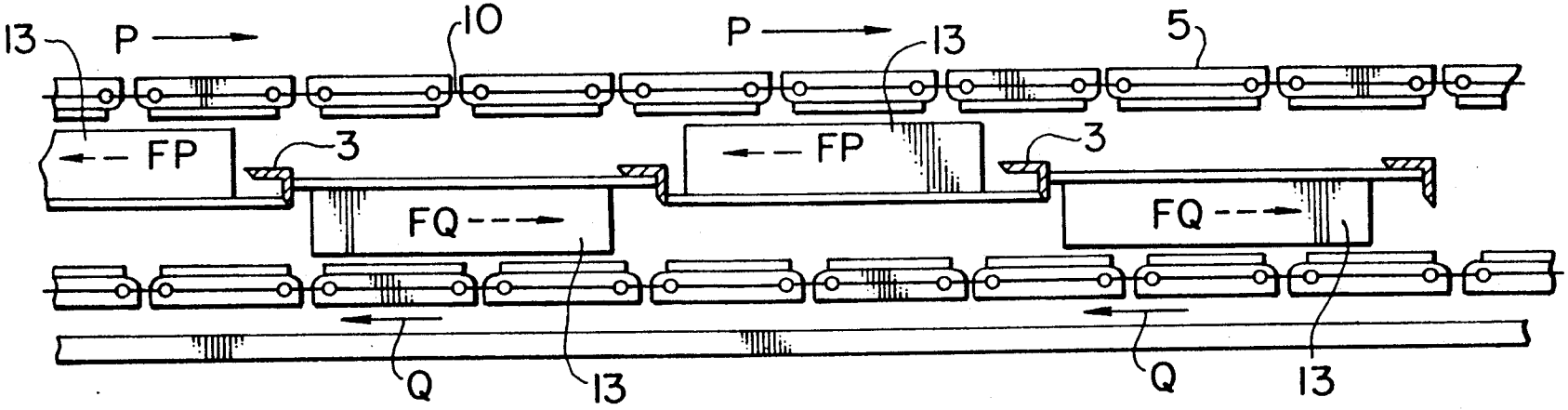
FIG. 5 is a side-elevational view showing a support construction for stators of a linear motor.

In this embodiment, since the first group (upper side) of stators 13*a* and 13B and the second group (lower side) of the stators 13A and 13B are disposed in opposed relation to the advance travel path and the return travel path of the treadboards 5, respectively, the driving forces, as indicated by arrows P and Q in FIG. 5, can be uniformly applied to the treadboards 5 interconnected in an endless manner. Therefore, the driving force at the advance travel path of the treadboards 5 is balanced with the driving force at the return travel path, and each treadboard 5 can be moved smoothly. And besides, since the reaction forces FP and FQ respectively acting on the stators 13 at the advance travel path and the stators 13 at the return travel path are in opposite directions, these reaction forces FP and FQ cancel each other, so that these reaction forces will not act on the horizontal members 3 supporting the stators 13. Further, since the pair of chains 10 interconnecting the treadboards 5 in an endless manner do not need to transmit the driving force, the chains 10 need only to have a strength of such a degree as to prevent the adjacent treadboards 5 from moving away from each other.

Figure 6:
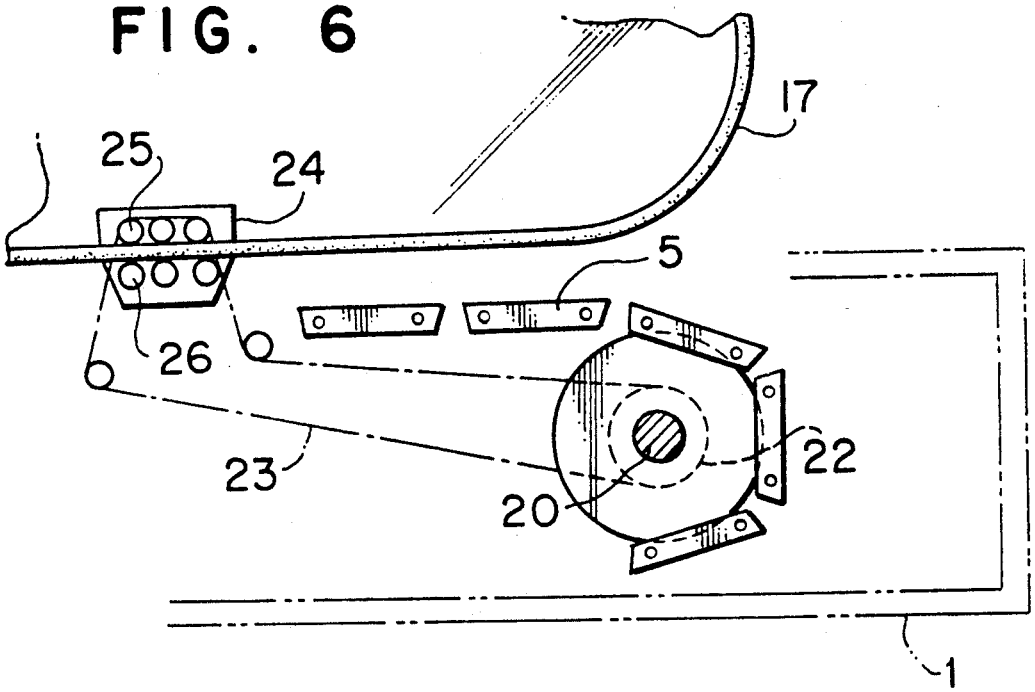
FIG. 6 is a schematic side-elevational view showing a drive mechanism for a moving handrail of the passenger conveyor of the present invention.
Figure 7:
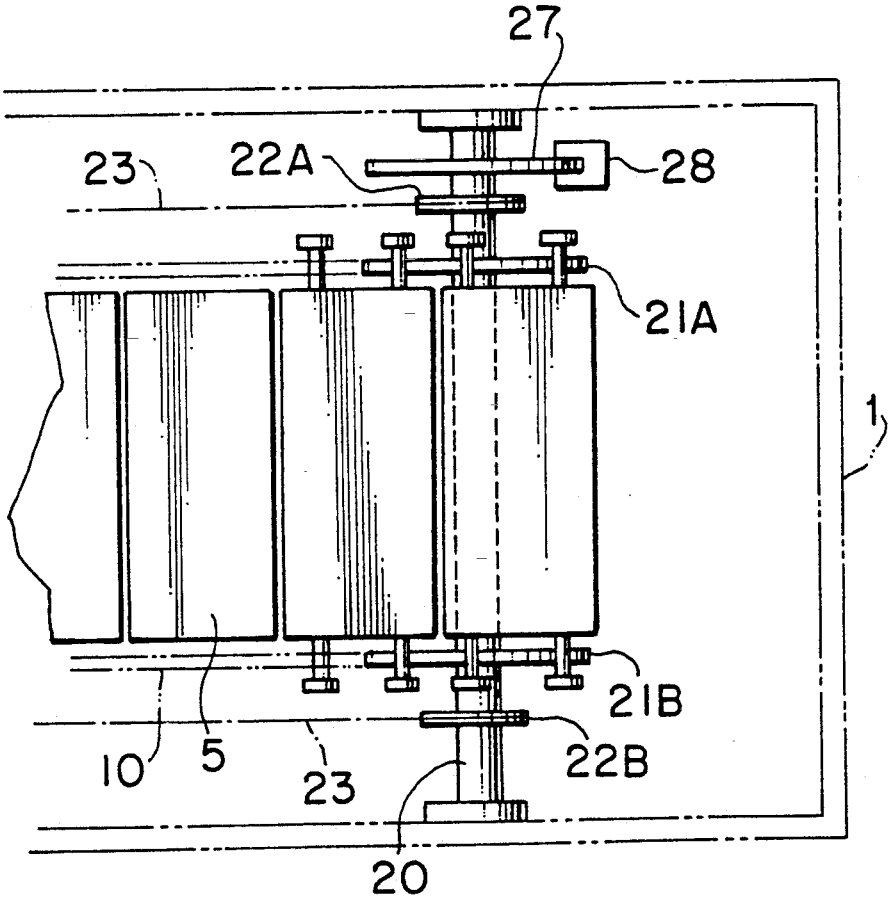
FIG. 7 is a plan view of the portion shown in FIG. 6.

Next, the driving of the moving handrails 17 as well as the braking of the treadboards 5 will now be described with reference to FIGS. 6 and 7. The plurality of treadboards 5 interconnected by the chains 10 in an endless manner are guided by a pair of sprockets 21A and 21B at each of the entrance and the exit of the electrically-operated road where the path of travel of the treadboards 5 is inverted. The pair of sprockets 21A and 21B are fixedly mounted on a rotatable shaft 20 supported on the main frame 1, and the pair of chains 10 are extended around the pair of sprockets 21A and 21B, respectively. A pair of drive sprockets 22A and 22B are fixedly mounted on at least one of the two rotatable shafts 20 (each having the pair of sprockets 21A and 21B fixedly mounted thereon) provided respectively at the entrance and the exit of the electrically-operated road. A pair of transmission chains 23 are extended around the drive sprockets 22A and 22B, respectively, so as to drive a pair of handrail drive devices 24 for driving the pair of moving handrails 17, respectively. For example, the handrail drive device 24 comprises driven rollers 26 for holding the moving handrail 17 in a proper position, and drive rollers 25 for urging the moving handrail 17 against the driven rollers 26. The drive chain 23 drives the drive rollers 25 for rotation.

A rotary disk 27 is fixedly mounted on the rotatable shaft 20, and is disposed outwardly of the drive sprocket 22A. A brake device 28 is provided in opposed relation to the outer peripheral portion of the rotary disk 27. For example, the brake device 28 comprises a disk brake device designed to hold the opposite side faces of the rotary disk 27.

In the above construction, when the plurality of treadboards 5 are driven by the linear-motor to be moved, the chains 10 connected to the treadboards 5 are moved to rotate the sprockets 21A and 21B, so that the drive sprockets 22A and 22B on the rotatable shaft 20 are rotated. As a result, the transmission chains 23 extended respectively around the drive sprockets 22A and 22B rotate the drive rollers 25 of the respective handrail drive devices 24, so that the drive rollers 25, together with the driven rollers 26, move the moving handrails 17. When the operation of the electrically-operated road needs to be stopped, the brake device 28 is operated to brake or stop the rotary disk 27. By the braking of the rotary disk 27, the treadboards 5 are stopped through the rotatable shaft 20, the sprockets 21A and 21B and the chains 10.

Figure 8:
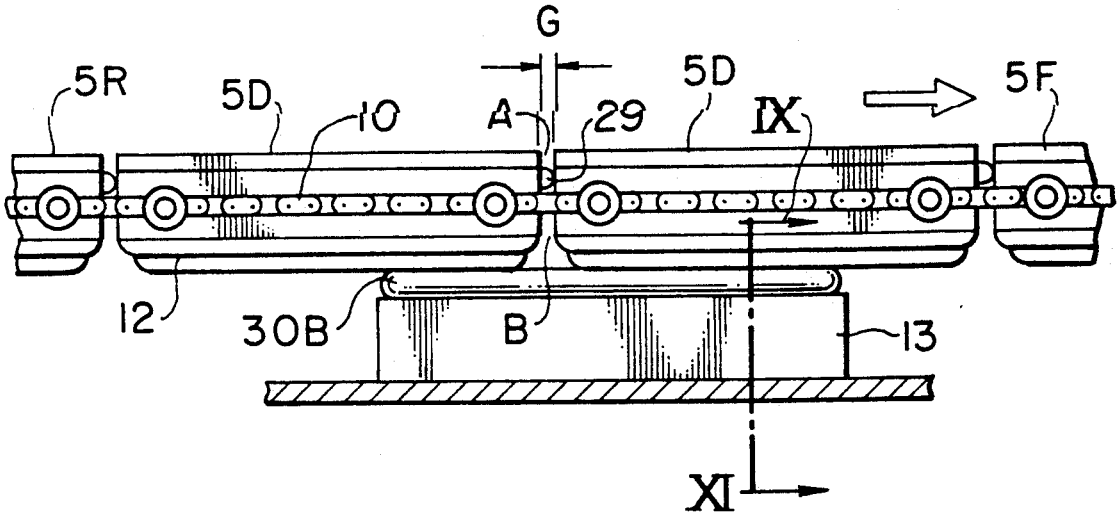
FIG. 8 is a side-elevational view of another embodiment of the present invention, showing the relationship between treadboards at the advance-travel path and stators of a linear motor.

In the above embodiment, the treadboards 5 provided with the moving members 12 are moved by the stators 13 of the linear motor, and the adjacent treadboards 5 are spaced at such a distance from each other as not to interfere with one another. Therefore, as shown in FIG. 8, when the treadboards 5D, 5F and 5R are moving in a direction of an arrow, the treadboards 5D receiving the driving force from the stators 13 push the treadboard 5F, already passed past this stator 13, with a reduced gap G between the treadboards 5D, and also pull the treadboard 5F, not yet reaching the stators 13, through the chains 10. This pushing and pulling are carried out each time the treadboards pass the stators 13; therefore, particularly when the treadboards 5D receiving the driving force push the treadboard 5F already past the stators 13, a sound due to collision is produced. Thus, noises are always produced.

In view of the above, a spacer 29 is formed on at least one of the opposed ends of the adjacent treadboards 5D, 5F, 5R so as to keep the gap G between the adjacent treadboards generally constant, thereby decreasing the change of the gap G. If the change of the gap G between the adjacent treadboards 5 is eliminated, the collision will not occur, so that the collision sound will not be produced. In this case, by forming the spacer 29 by an elastic material such as rubber or a spring, the spacer 29 can have a cushioning function. In FIG. 8, the spacer 29 is formed on the leading or front end A of one of the adjacent treadboards 5D, and is opposed to the trailing or rear end B of the other treadboard 5D. However, the spacers 29 may be provided respectively on the opposed leading and trailing ends A and B of the treadboards, or the spacers 29 may be provided respectively on the leading and trailing ends of one treadboard **5*d* in which case any spacer 29 is not provided on the treadboards disposed forwardly and rearwardly adjacent respectively to this treadboard 5D**.

Figure 1:
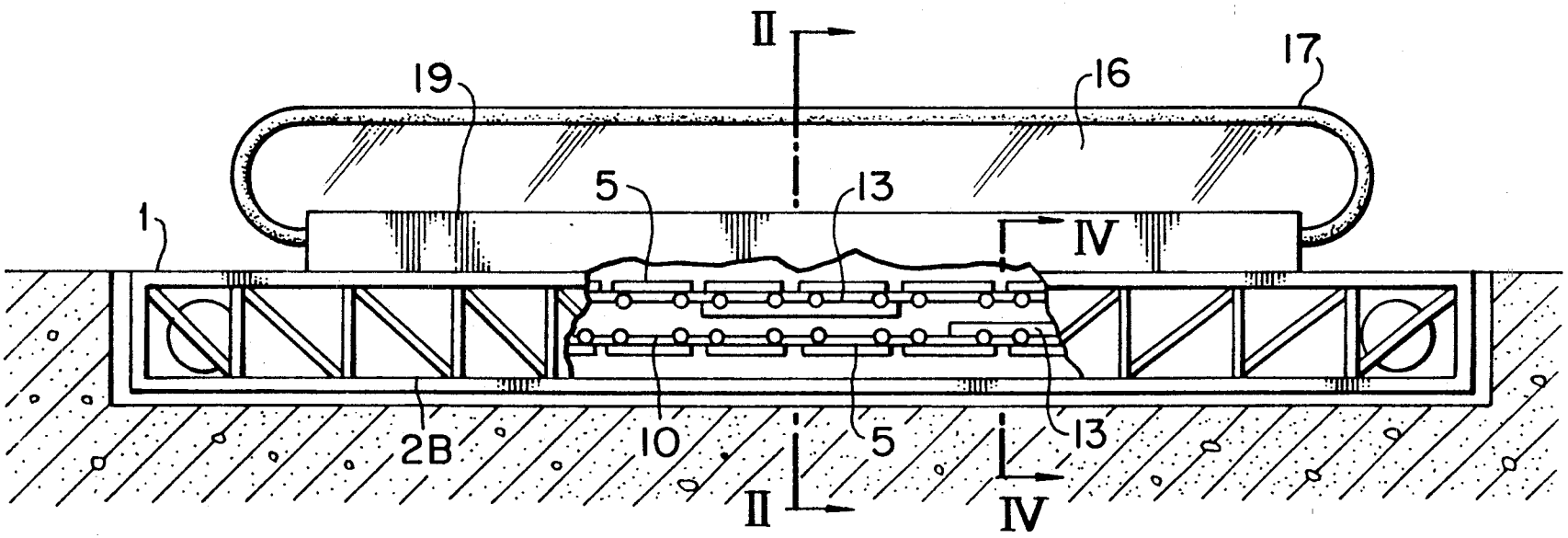
FIG. 1 is a partly-broken away, side-elevational view of a passenger conveyor provided in accordance with the present invention.
Figure 2:
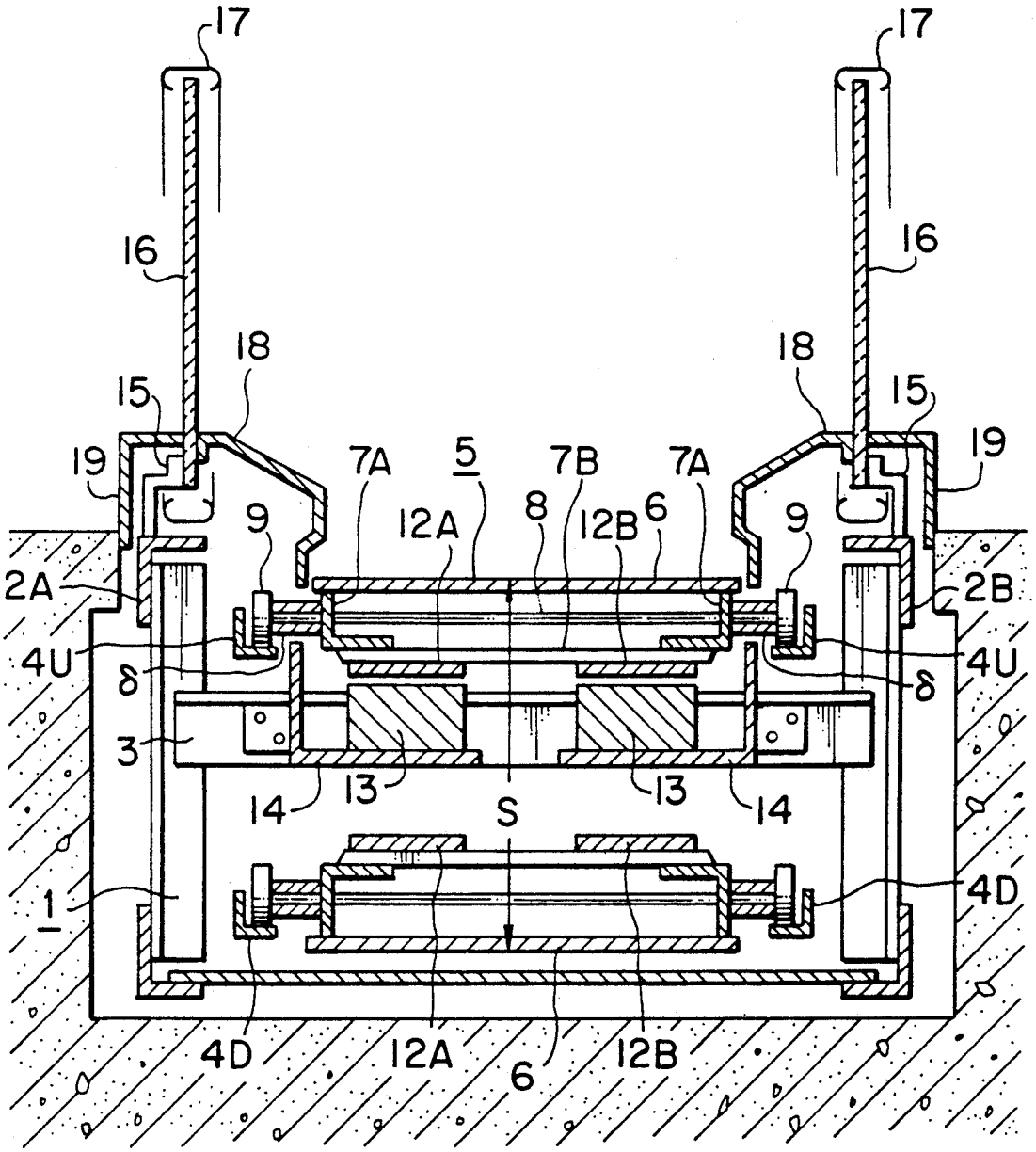
FIG. 2 is an enlarged, vertical cross-sectional view taken along the line II—II of FIG. 1.

As shown in FIG. 2, the treadboards 5 (5D, 5F, 5R) are moved along the advance-travel guide rails 4U through the rollers 9 mounted on the opposite ends of the shafts 8 extending through the treadboards. However, when the electromagnetic attractive force is exerted on the stators 13 during the operation of the linear motor, the treadboard 5 tends to be displaced downward through the moving members 12. In order to limit such displacement to a small level, it can be considered to increase a thickness of the shafts 8; however, even if the shafts 8 are made thicker, a large load acts on bearings (not shown) for the rollers 9, which bearings are mounted on the end portions of the shafts 8. In addition, in the case where a rubber tire is mounted on the outer periphery of each roller 9 so as to reduce noises, the rubber tire may be compressed to reduce the gap between the opposed moving member 12 and the stator 13. An undue compression of the rubber tire shortens the lifetime of the rubber tire, and when the gap between the stator 13 and the moving member 12 is reduced, they may be brought into contact with each other, and besides the driving force is changed to prevent a smooth movement of the treadboards.

Figure 9:
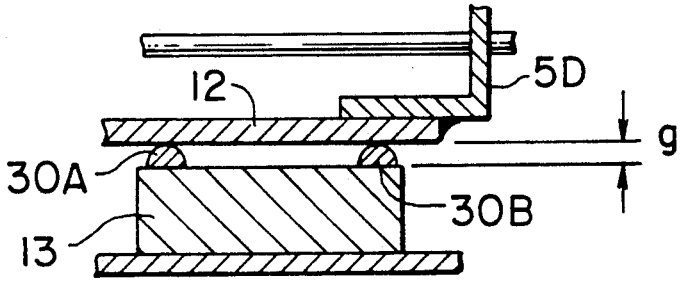
FIG. 9 is an enlarged cross-sectional view taken along the line IX—IX of FIG. 8.

Therefore, as shown in FIGS. 8 and 9, gap-keeping members 30A and 30B for keeping the gap g between the opposed surfaces of the stator 13 and the moving member 12 constant are provided on that surface of the stator 13 opposed to the moving member 12, with the gap-keeping members 30A and 30B being spaced from each other in the direction of travel of the treadboards 5. The gap-keeping members 30A and 30B are made of a sliding material.

With this construction, even when the electromagnetic attractive force acts between the moving member 12 and the stator 13, the gap g therebetween can be kept generally constant by the gap-keeping members 30A and 30B. Therefore, there is no need to make the shafts 8 of the rollers 9 thick, and in the case where the rubber tire is mounted on each roller 9, the rubber tire is not excessively compressed. Further, since the gap g is kept constant, the driving force produced by the linear motor is generally uniform. Incidentally, in the case where the rubber tire is mounted on each roller 9, a gap corresponding to the amount of compression of the rubber tires at the time when passengers get on the electrically-operated road is preferably beforehand provided between the gap-keeping members 30A and 30B and the moving member 12. This eliminates the disadvantage that the gap-keeping members 30A and 30B bear the overall weight of the treadboard.

Figure 10:
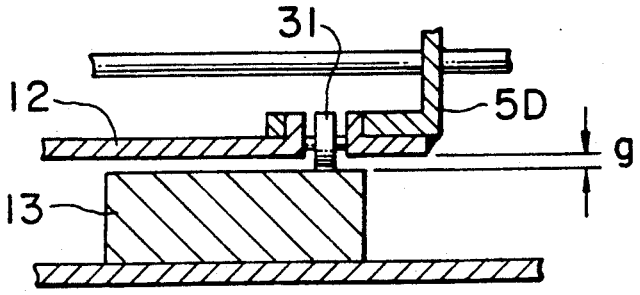
FIG. 10 is a view similar to FIG. 9, but showing a modified form of the invention.

The gap-keeping members 30A and 30B are the sliding members which are made of a non-magnetic material having a low coefficient of friction and a wear-resistance. However, since the gap-keeping members 30A and 30B are in contact with the moving member 12, the generation of the sliding resistance and sliding noises can not be avoided. Therefore, as shown in FIG. 10, non-magnetic rotary members 31 are projected from the moving member 12 (provided on the reverse side of the treadboard 5D) toward the stator 13. Due to the rotary members 31, the above-mentioned sliding resistance and sliding noises are eliminated. The amount of projection of the rotary member 31 from the moving member 12 is determined in view of the gap g between the moving member 12 and the stator 13.

Although the above description has been directed to the electrically-operated road movable in the horizontal direction, this construction can be, of course, applied to an electrically-operated road disposed in an inclined direction.

Figure 11:
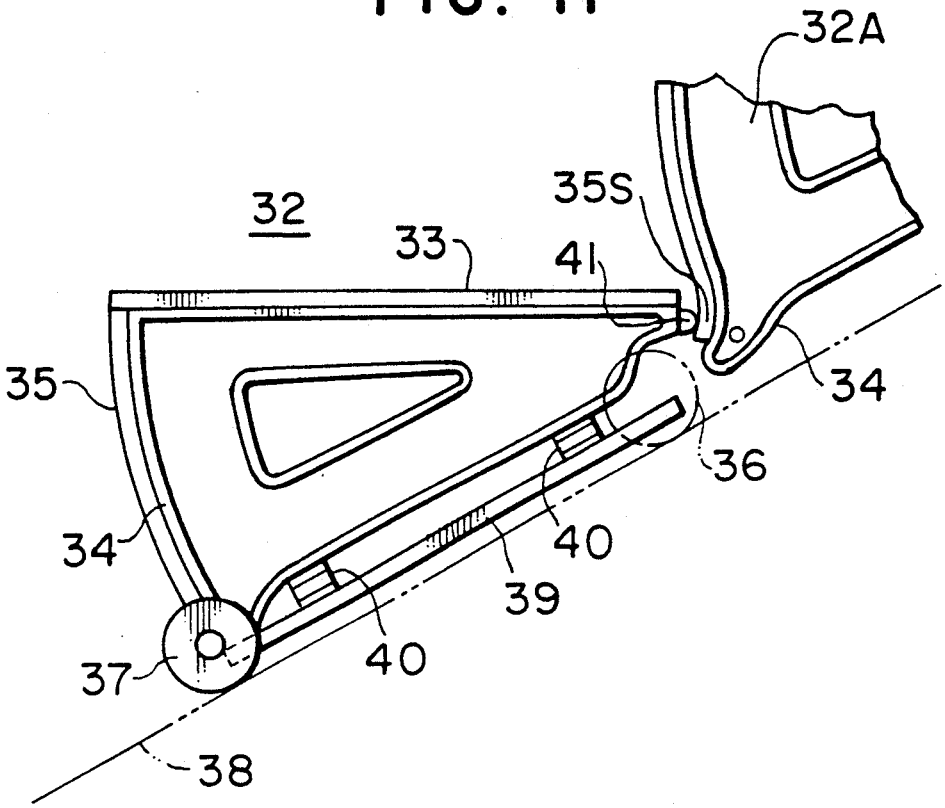
FIG. 11 a side-elevational view showing a modified treadboard of the invention.

The present invention also can be applied to an escalator inclined at an angle of around 30°. FIG. 11 shows a treadboard 32 for such an escalator. The treadboard 32 comprises a tread portion 33 on which the passenger stands, a pair of reinforcement frames 34 of a generally triangular shape respectively supporting the lateral side portions of the tread portion 33, a riser 35 extending downward from the rear end of the tread portion 33 and supported on the reinforcement frames 34, and front rollers 36 and rear rollers 37 rotatably supported by shafts supported respectively on the front and rear ends of the reinforcement frames 34 at the lower sides of the reinforcement frames 34. The treadboard 32 moves along a pair of guide rails 38 through the front and rear rollers 36 and 37. Although not shown in the drawings, the treadboard 32 is connected to its adjacent treadboard 32A through endless chains to which the shafts for the rollers 36 and 37 are supported, as described above for the electrically-operated road of the preceding embodiment. A moving member 39 of a linear motor is mounted on the lower surface of each of the pair of reinforcement frames 34 through support members 40, the moving member 39 being disposed between the pair of shafts for the front and rear rollers 36 and 37. The moving member 39 is formed into a flattened configuration in the direction of movement of the treadboard 32 and also in the direction of the width of the treadboard 32. Stators (not shown) of the linear motor provided so as to be opposed to the moving members 39 are arranged in the same manner as described above for the stators of the electrically-operated road of the preceding embodiment. In order to prevent a collision between the adjacent treadboards 32 and 32A during the operation of the linear motor, spacers 41 are mounted respectively on the front or leading ends of the reinforcement frames 34, and are projected to be opposed to a lower end 35S of the riser of the treadboard 32A. Since the reinforcement frames 34 are provided at the inner side of the riser lower end 35S, the riser lower end 35S will not be deformed when the spacers 41 collide therewith.

Figure 12:
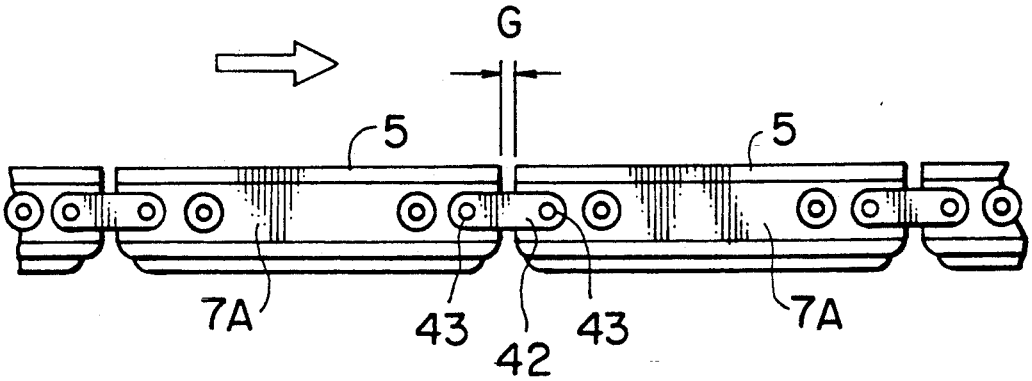
FIG. 12 is a view similar to FIG. 8, but showing a connecting construction for the treadboards.

In each of the above embodiments, the treadboards 5 (5D, 5F, 5R), 33 are interconnected by the chains 10 in an endless manner. Therefore, when the driving force acts on the rear-side treadboard, the chains can be easily loosened, so that the rear-side treadboard collides with the front-side treadboard. To prevent this, it is necessary to provide the spacers 29, 41. FIG. 12 shows a construction of interconnecting the treadboards in which the need for the spacers 29, 41 is obviated. More specifically, adjacent treadboards 5 are interconnected by connecting members 42. The connecting member 42 is made of a rigid material, and is pivotally connected at its opposite ends to the reinforcement members 7A of the adjacent treadboards 5 by pins 43 and 44. With this connecting construction, when the left-side treadboard 5 is driven to move in a direction of an arrow in FIG. 12, the right-side treadboard 5 is pushed through the connecting members 42, so that the gap G between the two treadboards 5 is not changed. Therefore, the collision between the two treadboards 5 will not occur, and noises and damage to the treadboards 5 which would otherwise be caused by the collision will not be produced.

Figure 13:
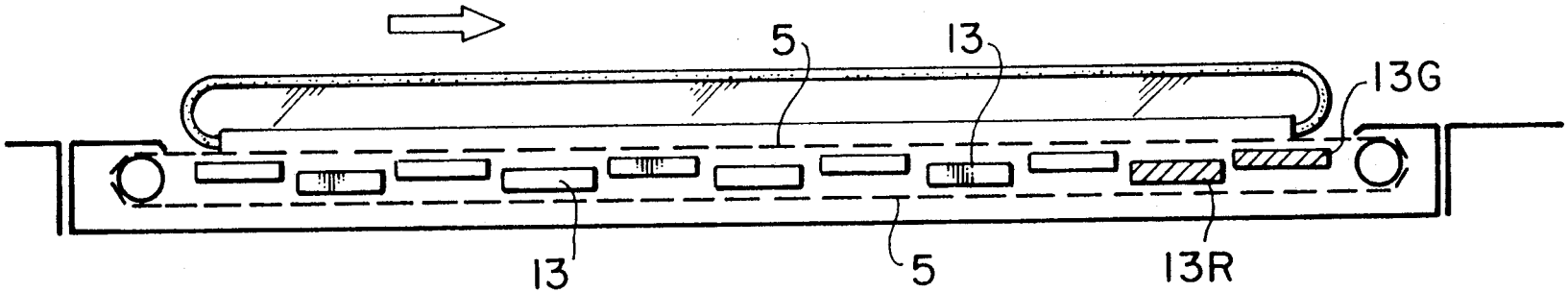
FIGS. 13 and 14 are side-elevational views showing different arrangements of the stators of the linear motor, respectively.

In FIG. 13, an upper row of stators 13 of the linear motor are arranged in opposed relation to the advance-travel path of the treadboards 5, and a lower row of stators 13 are arranged in opposed relation to the return-travel path of the treadboards 5. When the passenger conveyor is crowded with passengers, all the stators 13 are energized to operate the passenger conveyor; however, when no passenger or a small number of passengers get on the passenger conveyor, the stator 13G at the terminal end of the advance-travel path of the treadboards 5 is energized either alone or in combination with the stator 13R at the start point of the return-travel path. By operating the passenger conveyor in this manner, all the treadboards at the advance-travel path are pulled for movement, and therefore can be moved smoothly. However, when the stator at the start point of the advance-travel path and the stator at the terminal end of the return-travel path are energized, all the treadboards at the advance-travel path are pushed. Therefore, in the case where the treadboards are interconnected by the chains, there is a possibility that the chains are loosened, so that the treadboards are lifted from the guide rails. Therefore, this is not advisable.

Figure 14:
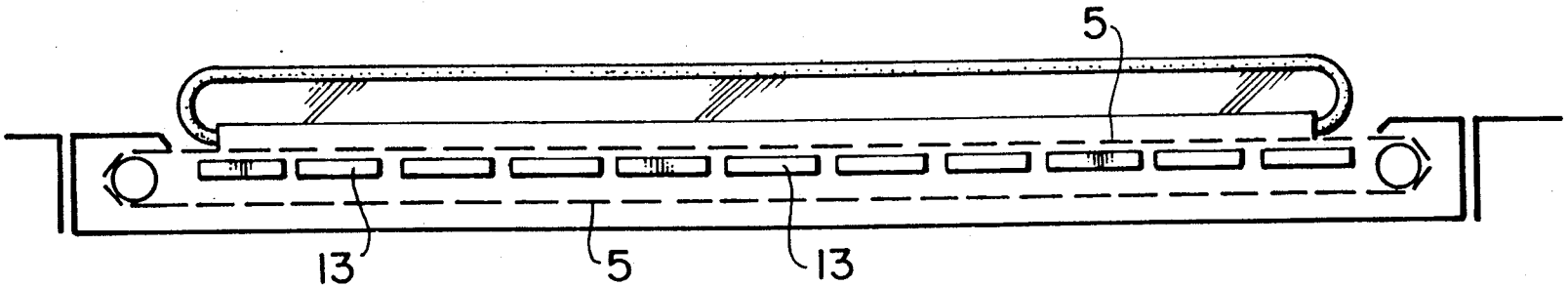

In FIG. 14, all the stators 13 of the linear motor are arranged in opposed relation to the advance-travel path of the treadboards 5. By energizing all the stators 13, most of the treadboards 5 at the advance-travel path can always obtain the driving force, and therefore the treadboards can stably travel with the passengers thereon.

As described above, in the present invention, the stators and the moving members which jointly constitute the linear motor are flattened in the direction of travel of the treadboards and in the direction of the width of the treadboard, and the stators and the moving members are provided between the advance-travel path and return-travel path of the treadboards. With this construction, the linear motor can be mounted without increasing the size of the passenger conveyor.

Further, by providing the gap-keeping means between the stator and the moving member of the linear motor and by providing the spacer between the adjacent treadboards, the treadboards can be moved smoothly.

What is claimed is:

1. In a passenger conveyor comprising a plurality of treadboards interconnected in a endless manner and being movable along an advance-travel path and a return-travel path disposed below said advance-travel path; and a linear motor for driving said treadboards;

the improvement wherein stators and moving members of said linear motor are formed such that surfaces thereof facing each other are located in horizontal planes;

said stators being disposed between said advance-travel path and said return-travel path; and said moving members are mounted on reverse sides of said treadboards, respectively, and wherein each of said treadboards are provided with a spacer formed on at least one of the opposed ends of any two adjacent ones of said treadboards so as to maintain a gap between said adjacent treadboards.

2. A passenger conveyor according to claim 1, wherein said spacer has a cushioning function.

3. In a passenger conveyor comprising a plurality of treadboards interconnected in an endless manner and being movable along a advance-travel path and a return-travel path disposed below said advance-travel path; and a linear motor for driving said treadboards; stators of said linear motor being disposed between said advance-travel path and said return-travel path, and moving members of said linear motor being mounted respectively on reverse sides of said treadboards so that said moving members can be vertically opposed to said stators;

the improvement comprising gap-keeping means for keeping a gap between said stator and said moving member.

4. A passenger conveyor according to claim 3, in which said stators and said moving members are formed into a flattened configuration in the direction of travel of said treadboards and in the direction of width of said treadboard.

5. A passenger conveyor according to claim 3 or claim 4, in which said gap-keeping means is provided on said moving member and is projected toward said stator.

6. A passenger conveyor according to claim 3 or claim 4, in which said gap-keeping means is provided on said stator and is projected toward said moving member.

7. A passenger conveyor according to claim 5, in which said gap-keeping means has a rotary member at its projected end.

8. A passenger conveyor according to claim 5, in which said gap-keeping means is made of a non-magnetic material.

9. A passenger conveyor according to claim 6, in which said gap-keeping means has a rotary member at its projected end.

10. A passenger conveyor according to claim 6, in which said gap-keeping means is made of a non-magnetic material.

11. A passenger conveyor according to claim 7, in which said gap-keeping means is made of a non-magnetic material.

12. In a passenger conveyor comprising a plurality of treadboards interconnected in an endless manner and being movable along an advance-travel path and a return-travel path disposed below said advance-travel path; and a linear motor for driving said treadboards;

the improvement wherein stators and moving members which jointly constitute said linear motor are formed into a flattened configuration in a direction of travel of said treadboards and in a direction of the width of said treadboard; said moving members being mounted on reverse sides of said treadboards; respectively; said stators being disposed between said advance-travel path and said return-travel path; and said stators being divided into a first group opposable to said moving members at said advance-travel path and a second group opposable to said moving members at said return-travel path.

13. A passenger conveyor according to claim 12, in which said stator of said first group and said stator of said second group are alternately arranged in the direction of travel of said treadboards.

14. In a passenger conveyor comprising a plurality of treadboards interconnected in an endless manner and being movable along an advance-travel path and a return-travel path disposed below said advance-travel path; a linear motor for driving said treadboards; and moving hand rail movable in synchronism with the movement of said treadboards;

the improvement wherein a rotary member is rotated by the movement of said treadboards; said moving handrail being driven to be moved by the rotation of said rotary member.

15. In a passenger conveyor comprising a plurality of treadboards interconnected in an endless manner and being movable along an advance-travel path and a return-travel path disposed below said advance-travel path; and a linear motor for driving said treadboards;

the improvement wherein a rotary member is rotated by the movement of said treadboards, and a brake device is provided for applying a braking force to said rotary member.

16. In a passenger conveyor comprising a plurality of treadboards interconnected in an endless manner and being movable along an advance-travel path and a return-travel path disposed below said advance-travel path; a linear motor for driving said treadboards; and moving handrail movable in synchronism with the movement of said treadboards;

the improvement wherein a first rotary member is rotated by the movement of said treadboards; a second rotary member and a third rotary member are rotated by the rotation of said first rotary member; said moving handrail is driven by the rotation of said second rotary member; and a brake device is provided for applying a braking force to said third rotary member.

17. A passenger conveyor according to claim 16, in which said first rotary member is a guide rotary member for guiding the inversion of said treadboards between said advance-travel path and said return-travel path.

18. In a method of operating a passenger conveyor comprising a plurality of treadboards interconnected in an endless manner and being movable along an advance-travel path and a return-travel path disposed below said advance-travel path; a plurality of linear motors for driving said treadboards;

the improvement comprising selecting a number of said plurality of linear motors being driven in dependance upon an operating condition of said passenger conveyor.

19. In a method of operating a passenger conveyor comprising a plurality of treadboards interconnected in an endless manner and being movable along an advance-travel path and a return-travel path disposed below said advance-travel path; and a plurality of stators of a linear motor for driving said treadboards, said stators being disposed between said advance-travel path and said return-travel path and being arranged in the direction of travel of said treadboards;

the improvement comprising continuously energizing one of said plurality of stators in an opposed relationship to a terminal end of said advance-travel path during operation of said passenger conveyor.

* * * * *

UNITED STATES PATENT AND TRADEMARK OFFICE

CERTIFICATE OF CORRECTION

PATENT NO. : 5,295,568

DATED : March 22, 1994

INVENTOR(S) : SAITO ET AL.

It is certified that error appears in the above-indentified patent and that said Letters Patent is hereby corrected as shown below:

On the title page,
Please change the foreign priority application number from "2-67401" to -- 2-67041 --.

Signed and Sealed this

Eighteenth Day of May, 1999

*Attest:*

*Attesting Officer*

Q. TODD DICKINSON

*Acting Commissioner of Patents and Trademarks*